US007408157B2

(12) United States Patent
Yan

(10) Patent No.: US 7,408,157 B2
(45) Date of Patent: Aug. 5, 2008

(54) INFRARED SENSOR

(76) Inventor: Jason Yan, No. 8, Lane 108, Yazhou Rd., Tucheng City, Taipei County 236 (TW)

( * ) Notice: Subject to any disclaimer, the term of this patent is extended or adjusted under 35 U.S.C. 154(b) by 0 days.

(21) Appl. No.: 11/527,465

(22) Filed: Sep. 27, 2006

(65) Prior Publication Data

US 2008/0072394 A1 Mar. 27, 2008

(51) Int. Cl.
*G01J 5/00* (2006.01)

(52) U.S. Cl. ..... 250/338.1; 15/49.1

(58) Field of Classification Search ..... 250/338.1
See application file for complete search history.

(56) References Cited

U.S. PATENT DOCUMENTS 6,968,592 B2 * 11/2005 Takeuchi et al. ..... 15/319

2007/0016328 A1 * 1/2007 Ziegler et al. ..... 700/245

* cited by examiner

*Primary Examiner*—Constantine Hannaher
*Assistant Examiner*—Marcus H Taningco
(74) *Attorney, Agent, or Firm*—Birch, Stewart, Kolasch & Birch, LLP

(57) ABSTRACT

An infrared sensor at lower production cost for optimal massive production includes an infrared sensor unit disposed to the bottom of an automatic vacuum cleaner to measure the level of the ground to prevent the vacuum cleaner from turning overdue to any drop height created on the ground; a slide screen being disposed on the infrared sensor unit; and a small gateway to control the area for receiving energy of the infrared ray to precisely measure the drop height of the ground for the vacuum cleaner to automatically take turn whenever the drop height is detected to prevent a possible falling over.

6 Claims, 6 Drawing Sheets

INFRARED SENSOR

FIELD OF THE INVENTION

The present invention relates to an infrared sensor, and more particularly to an improved infrared sensor that can be applied to all sorts of vacuum cleaner.

BACKGROUND OF THE INVENTION

The prior art illustrated in FIG. 1 is related to a U.S. Pat. No. 6,594,844B2. As illustrated, a measurement 1 is applied on an instrument at the bottom of the automatic vacuum cleaner to emit at a certain inclination through an infrared ray 10 to a ground 12; and another infrared ray 14 receives the reflection. Meanwhile, the distances respectively among the infrared ray 10, the infrared ray 14 and the ground 12 are measured from a first path 16 and a second path 18. Once the distances respectively among the first path 16, the second path 18 and the ground changes, it indicates that the distances respectively among the infrared ray 10, the infrared ray 14 and the ground 12 also change accordingly so as to notify the automatic vacuum cleaner to take turns to avoid falling from the higher level on the ground.

However, the prior art is found with the following disadvantages. Firstly, a technical bottleneck exists about the range of detection distance by both of the infrared rays 10 and 14 at a certain inclination. The detection sensitivity becomes poor once a certain range is challenged. Secondly, should the eradiation of the infrared ray be adjusted for smaller power, it may effectively shorten up the detection distance between the infrared ray and the ground. However, the inaccurate measurement of the distance may still happen in case of a dark ground or a ground that pays back poor reflection.

SUMMARY OF THE INVENTION

A primary object of the present invention is to provide an improved structure of an infrared sensor to control the induction area receive by the infrared ray by means of a screen so to allow manual adjustment of the detection range thus to improve detection sensitivity.

Another object of the present invention is to provide an improved structure of an infrared sensor that effectively adjusts the detection depending on the ground condition to prevent the automatic vacuum cleaner to fall where higher level is found on the ground by having the infrared sensor and the screen mounted on the bottom of the automatic vacuum cleaner.

Another object yet of the present invention is to provide an improved structure of an infrared sensor that allows massive production at lower cost and is capable of increasing the receiving area of the infrared ray in case of a dark ground or a ground with poor reflection so as to achieve the optimal detection sensitivity without screening the infrared sensor unit; or reducing the receiving area if the ground is brighter or gives good reflection.

To achieve the above and other objects, the present invention includes an infrared sensor unit disposed at the bottom of an automatic vacuum cleaner to measure the distance between the cleaner and the ground to prevent the cleaner from falling off due to a drop height appearing on the ground. A slide screen is disposed on the infrared sensor unit to accurately measure the drop height. Once a drop height is detected, the infrared sensor notifies the vacuum cleaner to take turn. Meanwhile, the present invention allows massive production at lower cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
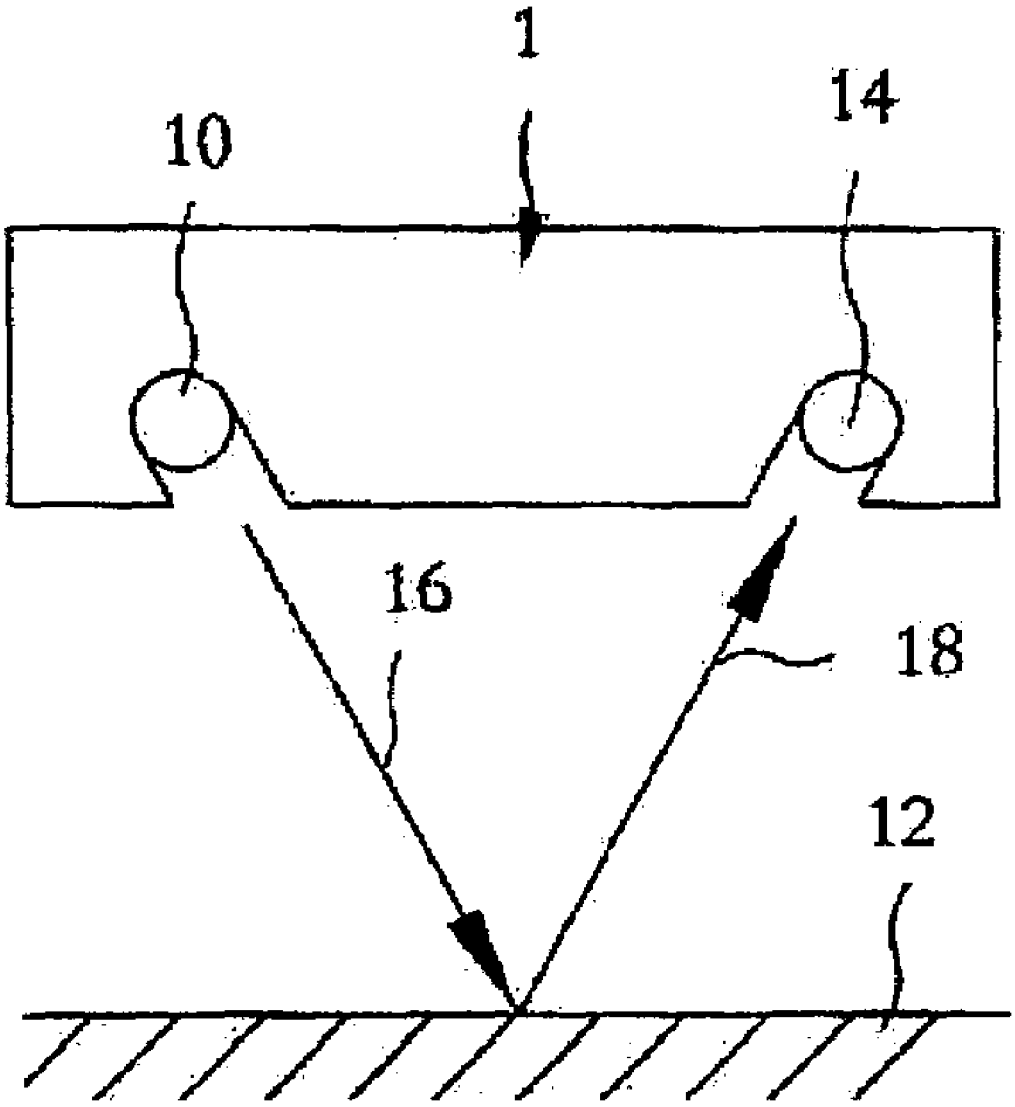
FIG. 1(prior art)
FIG. 1 is a schematic view of the prior art.
Figure 2:
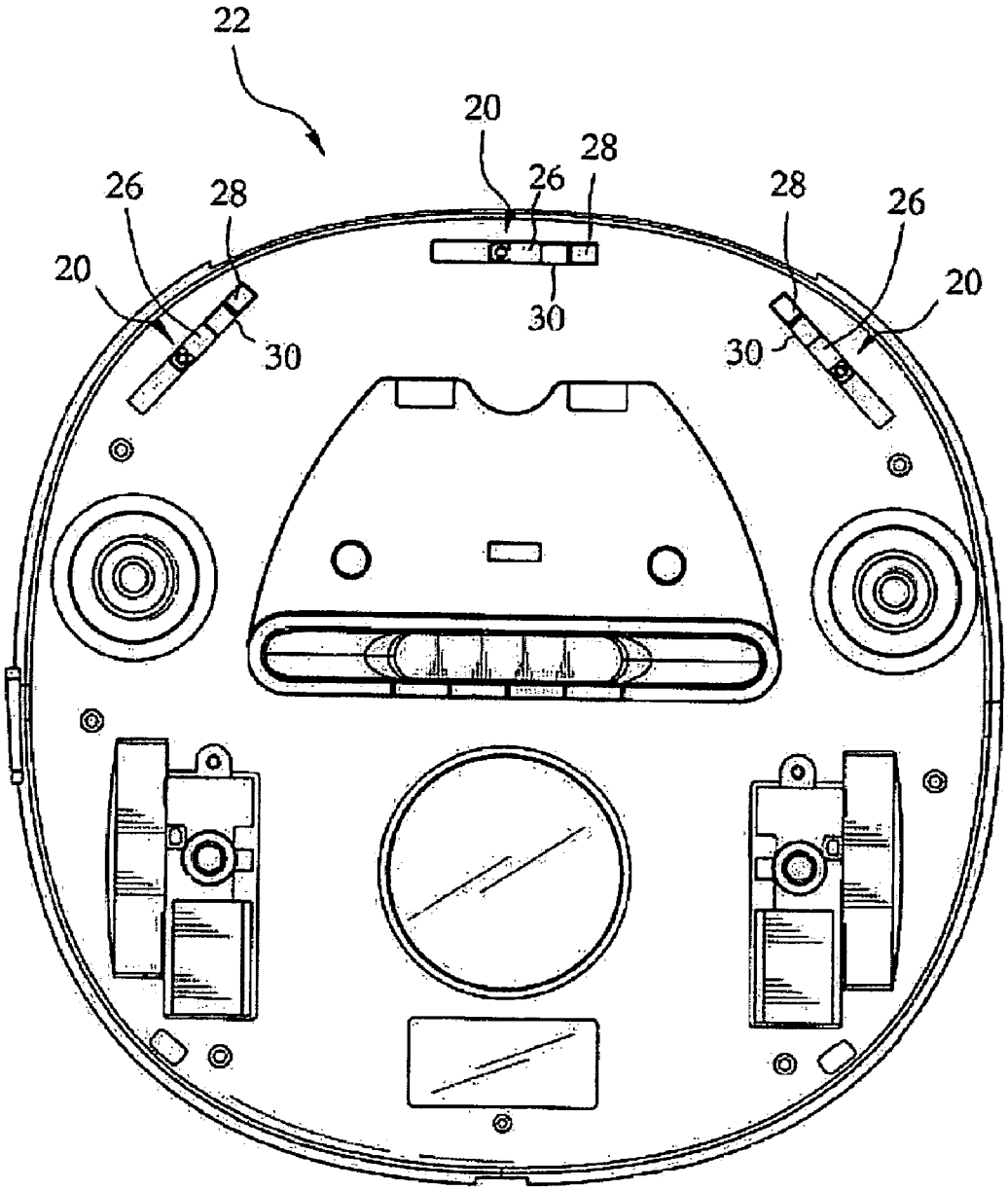
FIG. 2 is a vertical view showing that the infrared sensor of the present invention is adapted to the bottom of a vacuum cleaner.
Figure 3:
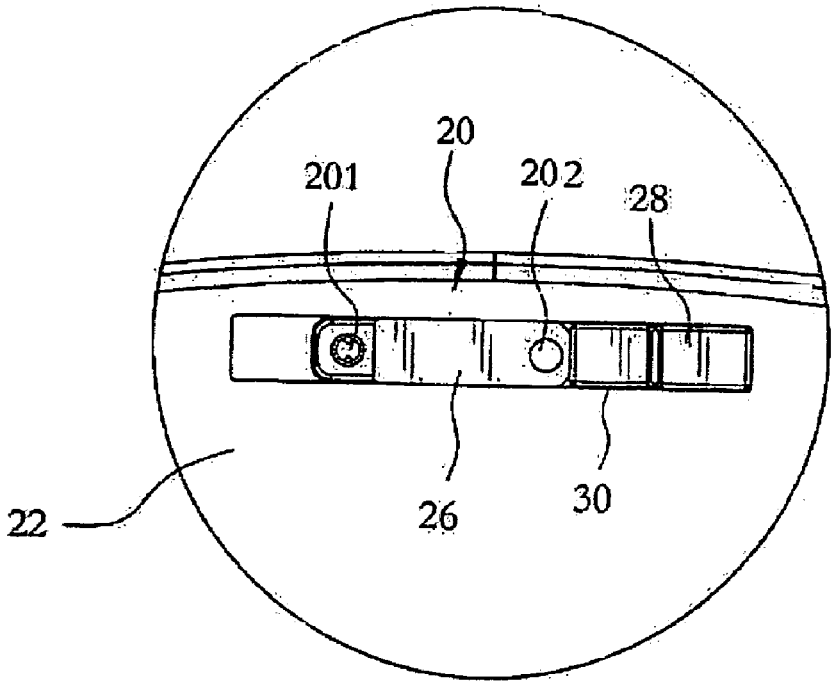
FIG. 3 is a schematic view showing a preferred embodiment of the infrared sensor of the present invention.
Figure 6:
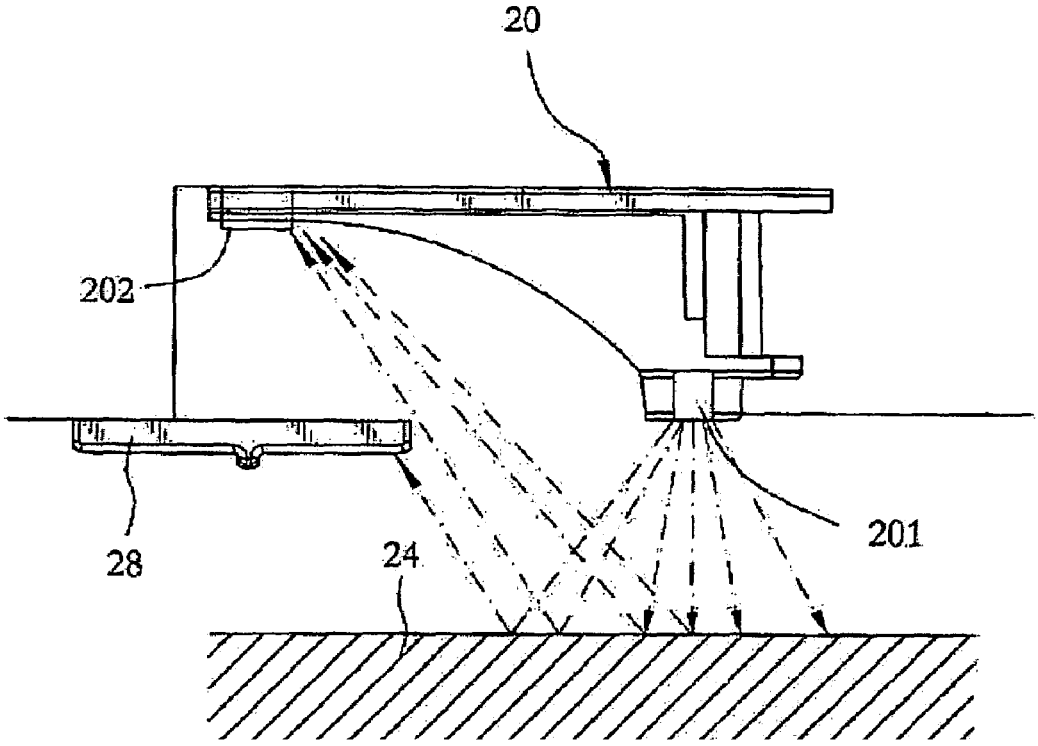
FIG. 6 is a sectional view of the infrared sensor of the present invention.
Figure 7:
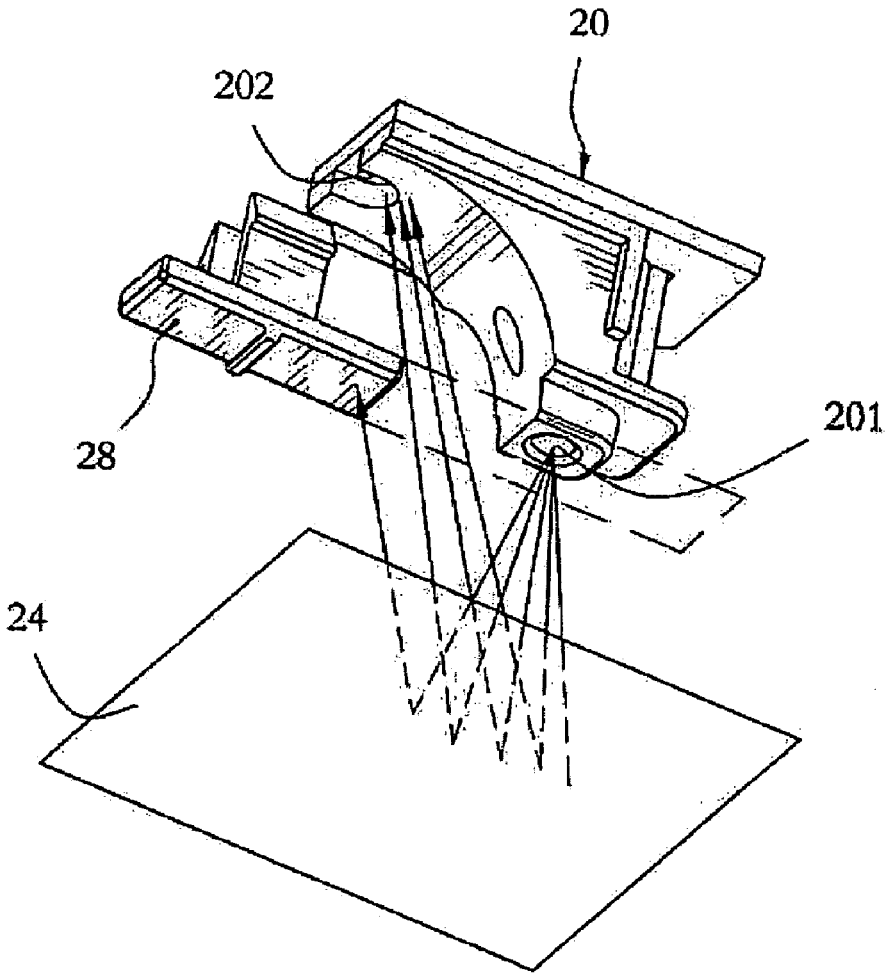
FIG. 7 is a perspective view of the infrared sensor of the present invention.

FIG. 2 is a vertical view showing that the infrared sensor of the present invention is adapted to the bottom of a vacuum cleaner; FIG. 3 is schematic view showing a preferred embodiment of the infrared sensor of the present invention; FIG. 6 is a sectional view of the infrared sensor of the present invention; and FIG. 7 is a perspective view of the infrared sensor of the present invention. The infrared sensor units 20 are disposed to the bottom of an automatic vacuum cleaner 22. The infrared rays are eradiated from a transmitter 201 disposed on each infrared sensor unit, then reflected by a ground 24, and picked up by a receiver 202 disposed on each infrared sensor unit to effectively measure the distance between the ground 24 and the automatic vacuum cleaner 22. Any instant change to the measurement will be immediately notified to the automatic vacuum cleaner 22 to stop advancing by giving a command to retreat or take a turn so as to prevent the automatic vacuum cleaner 22 from falling against any drop height caused by the fluctuation of the level of the ground 24. To eliminate a dead angle in detection resulted from excessively larger energy of infrared ray received when the reflection distance between the ground 24 and the conventional infrared sensor, or to correct the problem of insufficient detection sensitivity due to insufficient energy of the infrared ray or the poor condition of the ground 24, e.g., a dark floor or rug as found with the prior art, a small gateway 26 is disposed at the bottom of the automatic vacuum cleaner 22 and a slide screen 28 is disposed by the small gateway 26. The infrared ray energy picked up by the receiver 202 of the infrared ray unit is controlled by sliding the screen 28 in the small gateway 26. The scales 30 are provided on both sides in the small gateway 26 to lock up the slide screen 28 while the infrared sensor unit 20 is inserted into the small gateway 26.

FIG. 3 schematically shows another preferred embodiment of the infrared sensor unit. As illustrated, the small gateway is approximately with a length of 18 mm and a width of 7.2 mm while the energy of the infrared sensor unit 20 is approximately of 0.8 Watt. With the small gateway 26 fully opened, all the energy eradiated from the transmitter 201 of the infrared sensor unit is picked up by the receiver 202 of the infrared sensor unit with optimal detection sensitivity attainable at a distance of 5.5 cm. Multiple infrared sensor units 20 can be disposed on the automatic vacuum cleaner 22 and the slide screen 28 can be mounted to all sorts of devices that automatically detect the distance measured.

Figure 4:
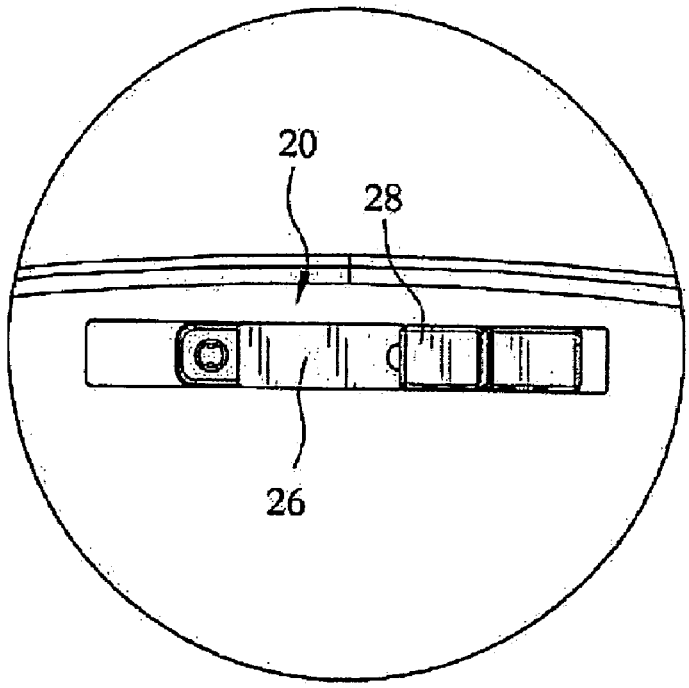
FIG. 4 is a schematic view showing another preferred embodiment of the infrared sensor of the present invention.

As illustrated in FIG. 4 for another preferred embodiment yet of the present invention, the slide screen 28 may change the size of the receiving area of infrared ray. When the size of the smaller gateway 26 is reduced to approximately 15 mm long and 7.2 mm wide, the receiving area by the infrared sensor unit 20 is reduced to five sixth of its original receiving capacity and the optimal detection distance to the ground is reduced to approximately 3.5 cm.

Figure 5:
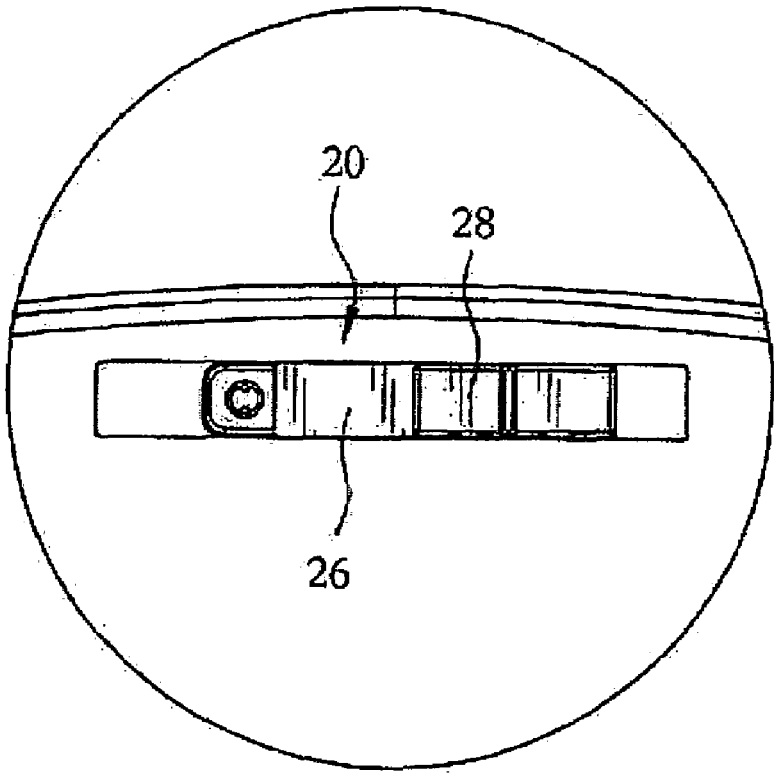
FIG. 5 is a schematic view showing another preferred embodiment yet of the infrared sensor of the present invention.

Now referring to FIG. 5 for another preferred embodiment yet of the present invention, the slide screen 28 may change the size of the receiving area of infrared ray. When the size of the smaller gateway 26 is reduced to approximately 13 mm long and 7.2 mm wide, the receiving area by the infrared sensor unit 20 is reduced to thirteen eighteenth of its original receiving capacity and the optimal detection distance to the ground is reduced to approximately 2.0 cm.

The present invention discloses an improved structure of an infrared sensor that measures the height of the ground through an infrared ray transmitter to prevent the vacuum cleaner from falling off due to the drop height created by the fluctuation of the ground level. A slide screen is disposed to the infrared sensor unit and the energy of infrared ray to be received is controlled by a small gateway to achieve accurate drop height of the ground. Once the drop height is detected, it will be automatically notified to the vacuum cleaner to take a turn to avoid falling. Furthermore, the infrared sensor of the present invention is optimal for massive production at lower cost.

What is claimed is:

1. An infrared sensor includes an infrared sensor unit adapted to the bottom of an automatic vacuum cleaner; a small gateway disposed also at the bottom of the automatic vacuum cleaner with the infrared sensor unit inserted into the small gateway; and a slide screen disposed by the small gateway with the screen secured to the small gateway by multiple locking scales provided on both sides of the smaller gateway.

2. The infrared sensor as claimed in claim 1, wherein the slide screen is capable of changing the size of the area to receive the infrared ray.

3. The infrared sensor as claimed in claim 1, wherein the infrared sensor unit is vertically projected to the ground.

4. The infrared sensor as claimed in claim 1, wherein the infrared sensor unit and the screen are adapted to be within the automatic sense range of any device.

5. The infrared sensor as claimed in claim 1, wherein multiple infrared sensors and the screen are disposed on the automatic vacuum cleaner.

6. The infrared sensor as claimed in claim 1, wherein the multiple locking scales control the size of the receiving area of the slide screen.

* * * * *